US005809904A

United States Patent [19]

Darby

[11] Patent Number: 5,809,904

[45] Date of Patent: Sep. 22, 1998

[54] PALLET SYSTEM INCLUDING BASE PALLET WITH RIGID SUBFRAME

[75] Inventor: Robert J. Darby, Greensboro, N.C.

[73] Assignee: T.H.E.M. International, Inc., Greensboro, N.C.

[21] Appl. No.: 866,856

[22] Filed: May 30, 1997

[51] Int. Cl.[6] ..... B65D 19/44

[52] U.S. Cl. ..... 108/55.3; 108/535; 108/56.3; 206/600; 206/394

[58] Field of Search ..... 108/51.11, 55.3, 108/53.5, 56.1, 56.3, 57.17, 57.23, 57.32, 57.37; 206/591, 596, 600, 386, 394

[56] References Cited

U.S. PATENT DOCUMENTS

| | | | |
|---|---|---|---|
| 4,133,270 | 1/1979 | Ravera | 108/51.1 |
| 4,220,100 | 9/1980 | Palomo et al. | 108/51.1 |
| 4,802,421 | 2/1989 | Atterby et al. | 108/51.1 |
| 4,972,782 | 11/1990 | Shepherd | 108/52.1 |
| 5,042,396 | 8/1991 | Shuert | 108/51.1 |
| 5,255,613 | 10/1993 | Shuert | 108/901 |
| 5,351,628 | 10/1994 | Breezer et al. | 108/51.1 |
| 5,351,629 | 10/1994 | Breezer et al. | 108/56.3 |
| 5,483,899 | 1/1996 | Christie | 108/56.3 |
| 5,492,069 | 2/1996 | Alexander et al. | 108/56.3 |
| 5,531,327 | 7/1996 | Darby | 108/56.3 |
| 5,537,937 | 7/1996 | Juvik-Woods | 108/51.3 |

*Primary Examiner*—Peter M. Cuomo
*Assistant Examiner*—Gerald A. Anderson
*Attorney, Agent, or Firm*—Rhodes, Coats & Bennett, L.L.P.

[57] ABSTRACT

A pallet for supporting a plurality of packages, the pallet including a base member having a plurality of feet defining a plurality of gaps between adjacent feet and a subframe including a plurality of cross bars, each of the cross bars overlying and supported by the feet and spanning the gaps defined between the feet. A package position is provided for each of the packages. Each package position is located along a respective one of the cross bars and directly overlies a respective one of the gaps such that each of the packages when mounted on the pallet at a respective one of the package positions is suspended above the respective gap by the respective cross bar.

31 Claims, 9 Drawing Sheets

PALLET SYSTEM INCLUDING BASE PALLET WITH RIGID SUBFRAME

FIELD OF THE INVENTION

The present invention relates to pallets, and more particularly, to a pallet system including a base pallet having a relatively rigid subframe.

BACKGROUND OF THE INVENTION

A preferred method for transporting and storing yarn wrapped about cores or dye tubes (commonly referred to as "yarn packages") is to place a first layer of yarn packages on a base pallet, mount a separator pad over the layer of yarn packages, and place a further layer of yarn packages on the separator pad. Further layers of yarn packages and separator pads are formed, the last layer of yarn packages being covered by a top pallet. The assembly is surrounded at least about its sides by a shrink or stretch film wrap. The film wrap stabilizes the pallet assembly and prevents dust from entering and contaminating the yarn packages.

The base pallets utilized must be adapted for transport by means of a forklift, necessitating the provision of fork openings. As a result, the support surface upon which the yarn packages are placed is not directly supported by the ground, but instead is disposed over an array of feet and gaps between the feet which receive the tines of the forklift. The forklift openings and gaps generally must be arranged according to a standardized configuration. The standard configuration has two lengthwise entryways and two widthwise entryways, each entryway continuing through to the opposite side and intersecting the transverse entryways. The entryways so configured cut the base pallet into at least nine individual feet (four corner feet, one foot on each side between adjacent corner feet, and one center foot surrounded by entryways on each side).

A result of vertically stacking the yarn packages is that large point loads are applied to the support surface of the base pallet. Conventionally, yarn packages are placed onto each layer in a 2-1-2 array with each yarn package overlying or closely adjacent a respective one of the five feet. While the carrying capacity of the pallet assembly would be substantially increased by using a 2-2-2 array, such a configuration cannot satisfactorily be used. In particular, a 2-2-2 array requires that each yarn package core be located over a gap between feet. If the yarn packages are placed over the gaps, the weight of the stacked yarn packages tends to break or bow the support surface. In either case, the tension in the film wrap is relaxed, diminishing the stability of the pallet assembly. Thus there exists a need for a base pallet which allows the use of a 2-2-2 array of stacked yarn packages without allowing deflection or bending of the pallet which would jeopardize the stability of a pallet system.

Another problem encountered with prior art base pallets, even when a 2-1-2 yarn package configuration is used, is a tendency for the loaded pallet to bend when lifted by a forklift. Because the support surface is not supported by the feet (which are lifted off the ground), only the inherent rigidity of the pallet resists deflection. Such deflection diminishes the stability of the pallet system by overstretching and/or relaxing the tension in the film.

Also, the film tension itself may cause the pallet to bend or cantilever about the yarn packages along the edges of the pallet. Again, this effect tends to reduce the stability of the pallet system.

In practice, certain additional features of a pallet system as described above are very significant. The materials of the various components of the pallet system must be chosen with consideration of relative cost, weight, and overall ergonomics. Further, the materials must provide strength and durability to reasonably withstand damage from forklifts, conveyors and other handling tools. Further, it is desirable that the pallet system be reparable or that components thereof be replaceable without requiring replacement of the entire pallet system. Because the overall height of a storage or transport space (for example, the cargo hold of a truck or aircraft) may be limited, it is often critical that the components of the pallet system be as thin as possible to minimize the overall profile of the pallet system in both loaded and return configurations.

Thus, there exists a need for a pallet system having a base pallet with increased rigidity. In particular, there exists a need for such a pallet system wherein the base pallet is adapted to satisfactorily support yarn packages in an array of 2-2-2 or the like. Further, there is a need for such a base pallet which will resist deflection when lifted by a forklift or the like. The base pallet and pallet system should be cost effective, durable, and have good ergonomic properties. Additionally, there exists a need for such a pallet system which provides for convenient and cost effective reparability of the base pallet.

SUMMARY OF THE INVENTION

The present invention is directed to a pallet including a base member having first and second ends. The base member has at least two spaced apart first feet formed on the first end and defining a first gap therebetween. At least two spaced apart second feet are formed on the second end and define a second gap therebetween. At least two spaced apart intermediate feet are formed between the first and second ends of the base member and define an intermediate gap therebetween. The pallet includes a subframe removably mounted on the base member. The subframe includes a first cross bar, a second cross bar spaced apart from the first cross bar, and at least one intermediate cross bar disposed between and spaced apart from each of the first and second cross bars. The first, second, and intermediate cross bars overlie and are supported by the first, second, and intermediate feet, respectively, and span the first, second and intermediate gaps, respectively.

At least one connector bar may join the first, second, and intermediate cross bars to one another. Each foot may include a recess defined therein with portions of the cross bars disposed in the recesses. Preferably, the base member is molded from polymeric material. Preferably, the first, second, and intermediate cross bars are formed of a material having a flexural modulus of at least 35,000 MPa, and, more preferably, the material is aluminum. Preferably, each of the cross bars has opposed, free ends overlying the feet of the base member. At least one locator node may be secured to an upper surface of one of the cross bars at a location overlying one of the first, second, and intermediate gaps defined in the base member.

In a preferred embodiment, the pallet as described above includes at least one deck plate overlying and detachably secured to the base member. Preferably, the at least one deck plate is formed of a polymeric material. The subframe may be interposed between the base member and the deck plate. The deck plate may be detachably secured to the base member by at least one fastener. Preferably, the pallet includes a plurality of the deck plates. In a preferred embodiment, the subframe and the deck plates together form a substantially continuous support surface.

The present invention is further directed to a pallet including a base member having a plurality of feet defining a plurality of gaps between adjacent the feet and a subframe including a plurality of cross bars, each of the cross bars overlying and supported by the feet and spanning the gaps defined between the feet. A deck plate overlies the base member. Fastening means are provided operative when engaged to selectively secure the subframe and the deck plate to the base member. Each of the base member, the subframe, and the deck plate may be selectively separated from one another by disengaging the fastening means.

At least one connector bar may join the cross bars to one another. Each foot may include a recess defined therein with portions of the cross bars disposed in the recesses. Preferably, each of the base member and the deck plate are formed of polymeric material and the subframe is formed of metal. Preferably, the cross bars are formed of a material having a flexural modulus of at least 35,000 MPa, and, more preferably, the material is aluminum. Each of the cross bars may have opposed, free ends overlying the feet of the base member. At least one locator node may be secured to an upper surface of one of the cross bars at a location overlying one of the gaps defined in the base member.

In a preferred embodiment, the subframe is interposed between the deck plate and the base member. The pallet may include a plurality of the deck plates. Preferably, the subframe and the deck plates together form a substantially continuous support surface.

The present invention is further directed to a pallet for supporting a plurality of packages. The pallet includes a base member having a plurality of feet defining a plurality of gaps between adjacent feet and a subframe including a plurality of cross bars, each of the cross bars overlying and supported by the feet and spanning the gaps defined between the feet. A package position is provided for each of the packages. Each package position is located along a respective one of the cross bars and directly overlies a respective one of the gaps such that each of the packages when mounted on the pallet at a respective one of the package positions is suspended above the respective gap by the respective cross bar.

At least one connector bar may join the cross bars to one another. Each foot may include a recess defined therein with portions of the cross bars disposed in the recesses. Preferably, each of the base member and the deck plate are formed of polymeric material and the subframe is formed of metal. Preferably, the cross bars are formed of a material having a flexural modulus of at least 35,000 MPa, and, more preferably, the material is aluminum. Each of the cross bars may have opposed, free ends overlying the feet of the base member. At least one locator node may be secured to an upper surface of one of the cross bars at a location overlying one of the gaps defined in the base member.

In a preferred embodiment, the subframe is interposed between the deck plate and the base member. The pallet may include a plurality of the deck plates. Preferably, the subframe and the deck plates together form a substantially continuous support surface.

A locator node may be secured to upper surfaces of the cross bars at each of he package positions.

The preceding and objects of the present invention will be appreciated by those of ordinary skill in the art from a reading of the figures and the detailed description of the preferred embodiment which follow, such description being merely illustrative of the present invention.

DETAILED DESCRIPTION OF THE PREFERRED EMBODIMENT

Figure 7:
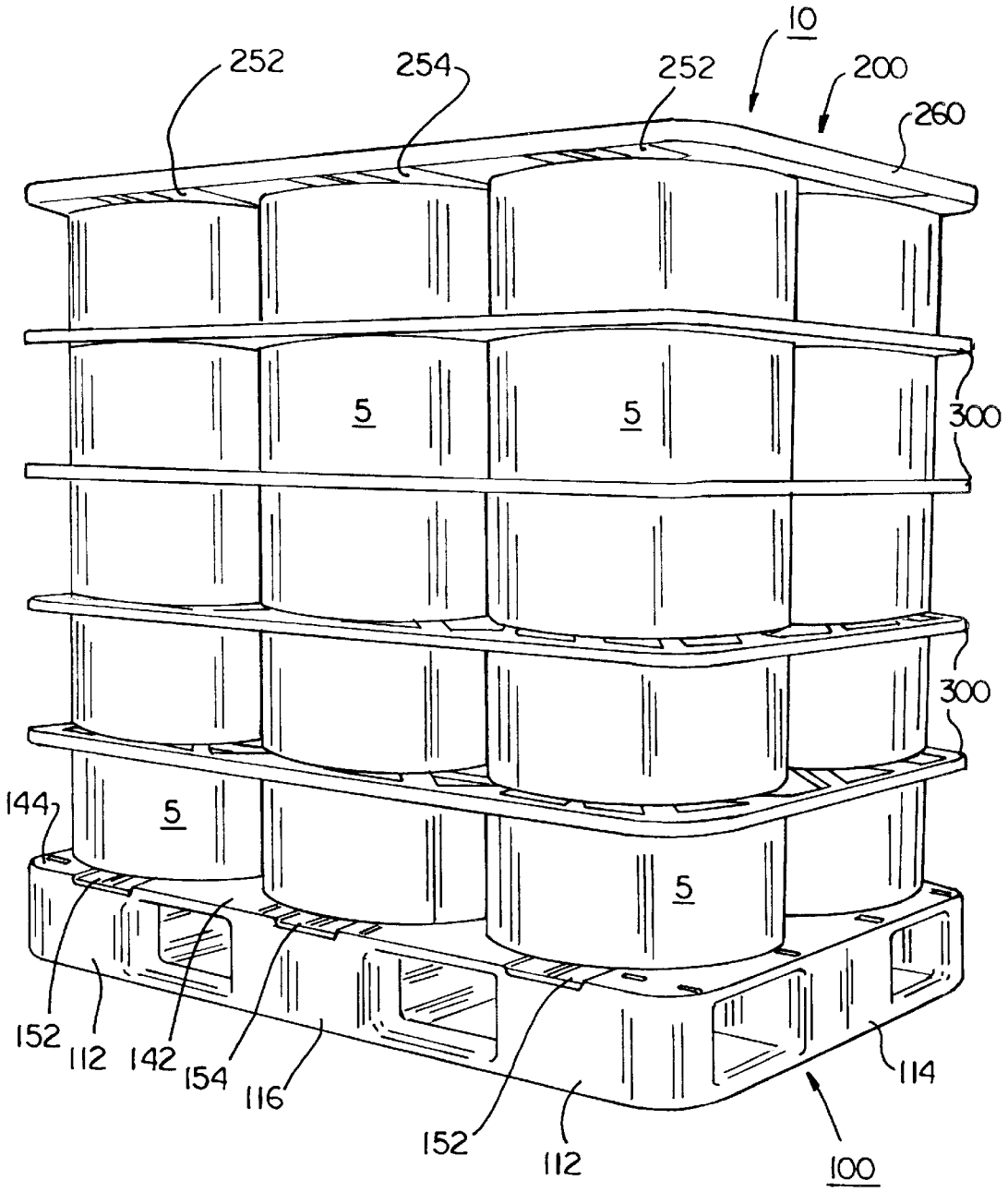
FIG. 7 is a perspective view of the pallet system loaded with yarn packages.
Figure 8:
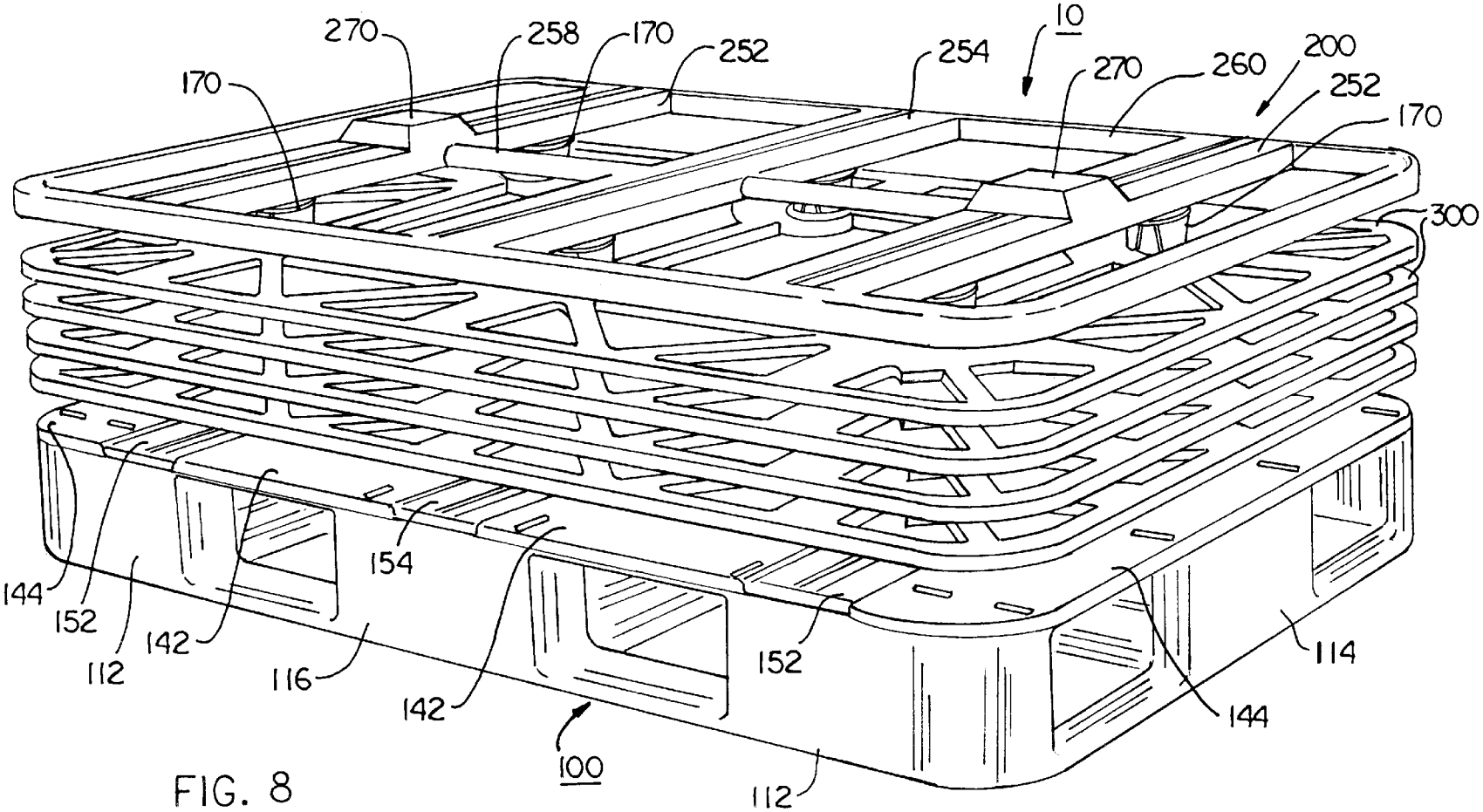
FIG. 8 is a perspective view of the pallet system in a return configuration.
Figure 9:
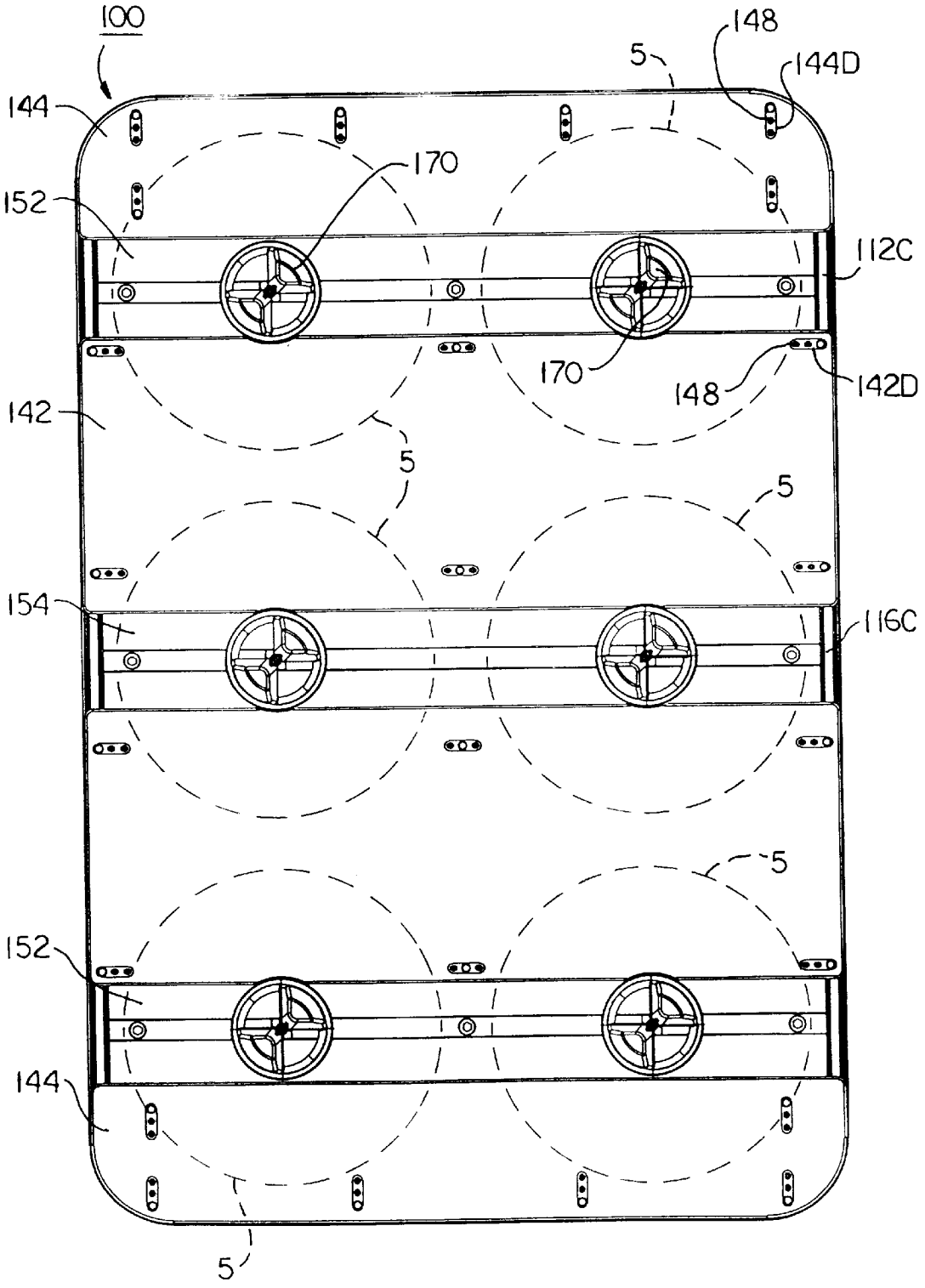
FIG. 9 is a schematic, plan view of the base pallet with packages shown in dashed lines.

With reference to FIGS. 7 and 8, a pallet system 10 according to the present invention for carrying yarn packages 5 or the like is shown therein. The pallet system as described herein is adapted for use with packages 5 of the type including a film or strand wrapped about a central core. In FIGS. 7 and 9 (dashed lines), the pallet system is shown as loaded with packages 5 in a 2-2-2 array. In practice, the loaded pallet system is wrapped with shrink or stretch wrap about its top and sides to give the assembly increased stability and to prevent exposure of the packages 5 to dust or moisture. FIG. 8 shows the pallet system 10 in a return configuration.

Pallet system 10 includes generally base pallet 100, top pallet 200 and separator pads 300. Each of base pallet 100, top pallet 200 and separator pads 300 has locator nodes 170 adapted to fit within the respective cores of yarn packages 5. Fork openings 120 (see FIGS. 2 and 7) of base pallet 100 preferably have a width of from about 200 mm to 220 mm and a height of from about 90 mm to 100 mm, so that the pallet is thereby in compliance with accepted industry standards.

Turning to base pallet 100 in more detail, base pallet 100 includes generally base member 110, subframe 150, deck plates 142, 144, and nodes 170. Preferably, base member 100 and deck plates 142, 144 are formed of high density polyethylene. Suitable methods for forming base member 110 and deck plates 142, 144 include high or low pressure injection molding. Alternative materials for the base member and deck plates include low density polyethylene. Subframe 150 is preferably formed of extruded aluminum. Alternative materials for the subframe include steel or glass reinforced polycarbonate. Preferably, the material chosen for subframe 150 will have a minimum flexural modulus of 35,000 MPa. More preferably, the material will have a flexural modulus at least 75,000 MPa and a yield strength of at least 200 MPa.

Figure 1:
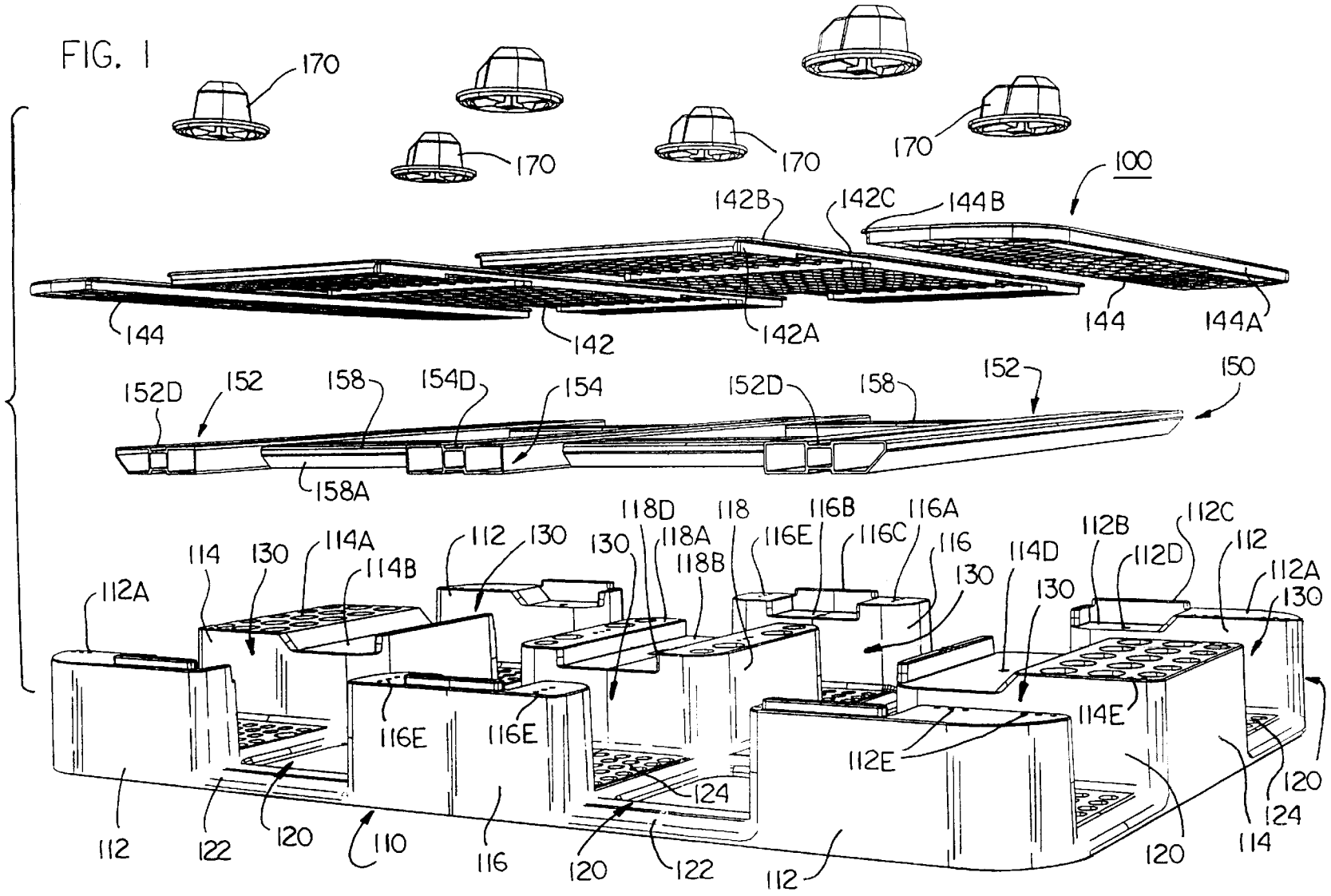
FIG. 1 is an exploded, perspective view of a base pallet according to the present invention.

As best seen in FIG. 1, base member 110 is preferably of unitary construction, although it may be formed of a plurality of components secured together. Base portion 110 has vertically extending feet 112, 114, 116, and 118. Gaps 130 are defined between feet 112 and adjacent feet 114 and between feet 116 and foot 118. Openings 120 are defined between feet 112 and adjacent feet 116. The lower ends of the feet are joined to one another by connectors 122 at openings 120 and by panels 124 elsewhere. Feet 112, 114, 116, and 118 each have an upper end 112A, 114A, 116A, and 118A, respectively. Feet 112 and 116 each have a recess 112B and a recess 116B, respectively. A wall 112C and a wall 116C extend upwardly adjacent each of recesses 112B and 116B, respectively. Feet 114 and 118 each have channels 114B and 118B, respectively, formed in their upper ends. Subframe securement bores 112D, 114D, 116D, and 118D are formed in each of recesses and channels 112B, 114B, 116B, and 118B, respectively. Deck securement bores 112E, 114E, 116E, and 118E are formed in each of feet upper ends 112A, 114A, 116A, and 118A, respectively.

Base member 110 preferably has an overall length of from about 1100 mm to 1400 mm. Feet 112, 114, 116, 118 preferably have a height of from about 90 mm to 150 mm. Gaps 130 are preferably from about 200 mm to 250 mm wide.

Turning to subframe 150 in more detail, and as best seen in FIGS. 1–4, subframe 150 includes outer cross bars 152 and intermediate cross bar 154. Cross bars 152 and 154 are joined by connector bars 158. Preferably, bars 152, 154, and 158 form an open framework as shown, thereby minimizing the weight of the subframe and making it easier to handle. Each bar 152, 154, 158 is formed from three integral, hollow tubes as shown. This bar construction enhances the rigidity of each bar while minimizing the weight of the subframe. Walls 152A and 158A of outer ross bars 152 and walls 158A of connector bars 158 facing outwardly are sloped 45° with respect to horizontal. This configuration reduces the tendency of forklift tines inserted into the passageways of the bottom pallet 100 to become caught on subframe 150. Node securement bores 152C, 154C are formed in each of cross bars 152 and 154. Fastener bores 152B, 154B are formed in each of cross bars 152 and 154, as well.

Each cross bar 152, 154 is preferably from about 800 mm to 900 mm long and from about 100 mm to 150 mm wide. The outer tubes of each cross bar are preferably from about 25 mm to 30 mm high with the inner tube of each cross bar being from 4 mm to 8 mm shorter so that the three tubes of each cross bar define lengthwise channels 152D, 154D. Connector bars 158 are each preferably from about 300 mm to 350 mm long, from about 100 mm to 150 mm wide, and from about 25 mm to 30 mm high. The upper surface of each connector bar 158 is dropped relative to the upper surfaces of the adjacent cross bars, preferably from about 2 mm to 6 mm.

Inner deck plates 142 and outer deck plates 144 are shaped to fit the periphery of base member 110. The opposed edges of deck plates 142 and 144 have horizontally extending lips 142B and 144B, respectively. Cutouts 142C are formed in lips 142B. Skirts 142A and 144A are formed about each of deck plates 142 and 144, respectively. A network of ribs is provided to strengthen each deck plate. The upper surface of each deck plate is continuous and free of openings except for fastener apertures 142D and 144D.

Figure 2:
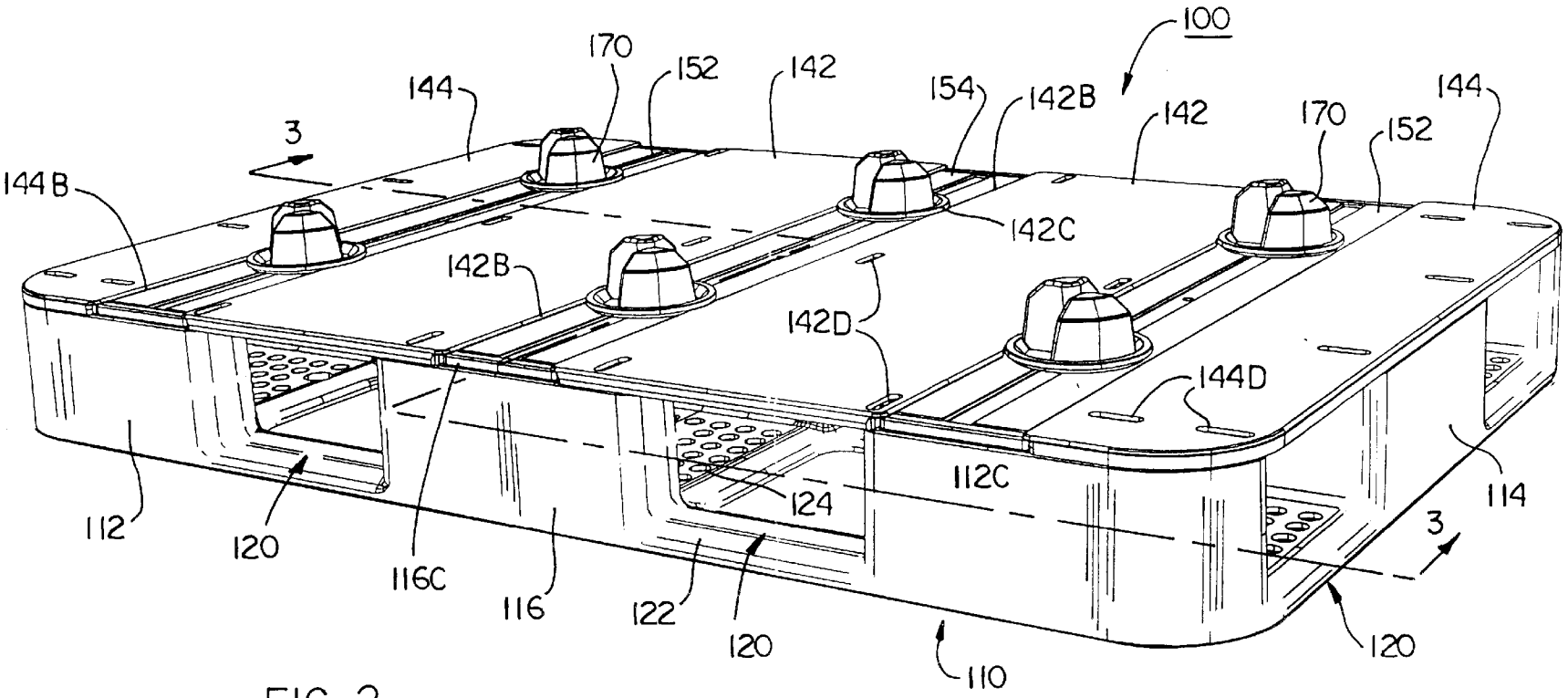
FIG. 2 is a perspective view of the base pallet.
Figure 3:
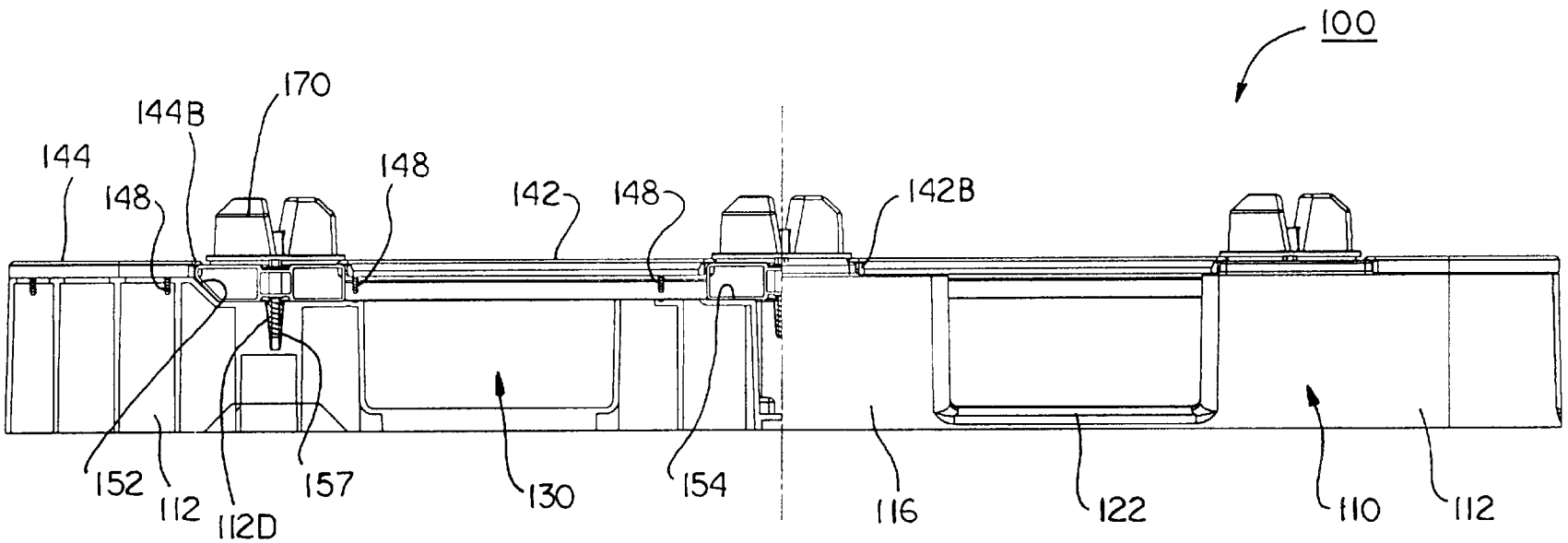
FIG. 3 is a Partial cross-sectional view of the base pallet taken along the line A—A of FIG. 3
Figure 4:
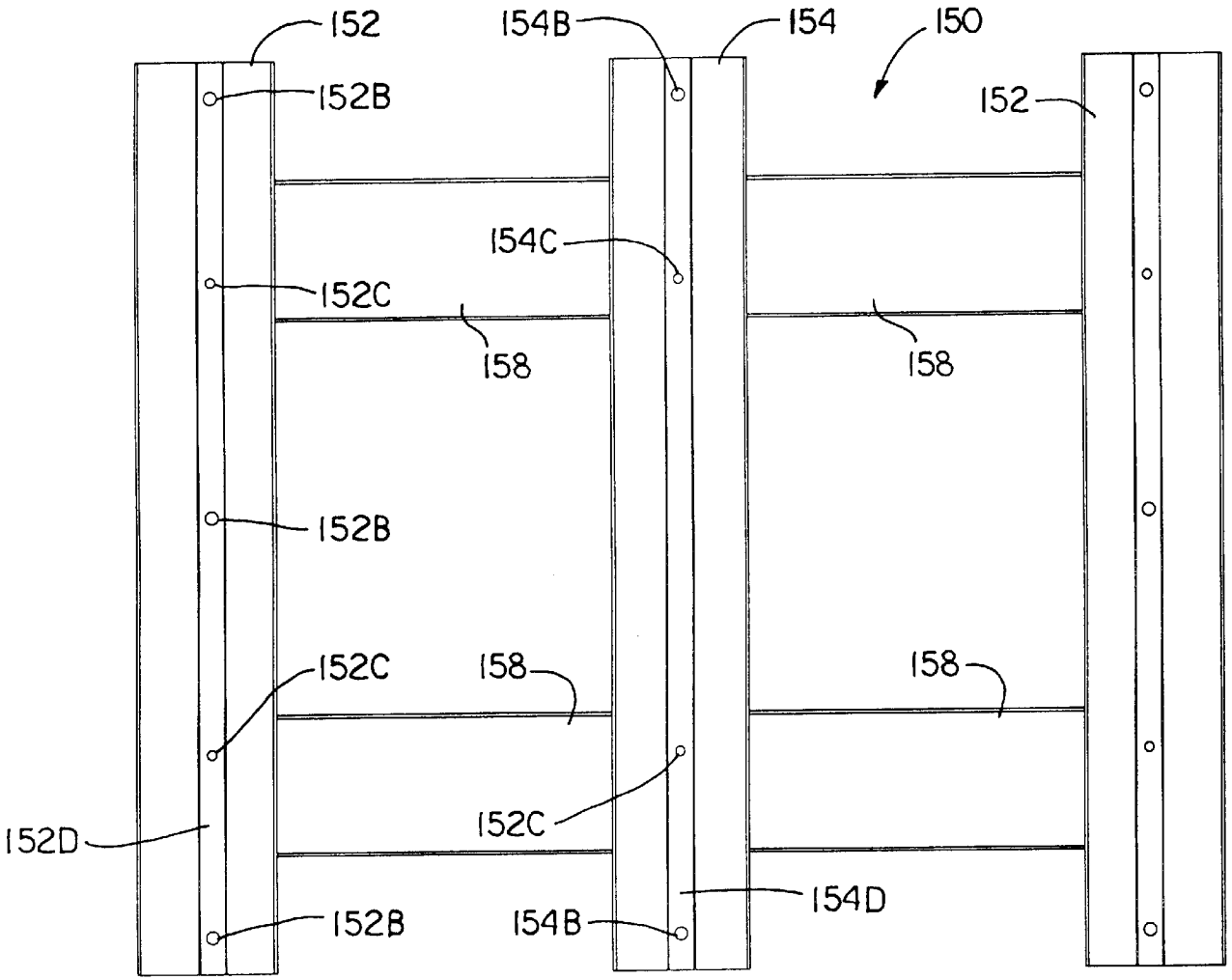
FIG. 4 is a top plan view of a subframe forming a part of the base pallet.

The assembled base pallet 100 is best seen in FIGS. 2 and 3. Subframe 150 is placed in recesses and channels 112B, 114B, 116B and 118B of the feet such that portions thereof span gaps 130 between the feet. Subframe 150 is held in place by fasteners (preferably self-tapping screws) 157 which are inserted through bores 152B, 154B and secured in bores 112D, 114D, 116D, and 118D. Nodes 170 are secured to subframe 150 by self-tapping screws (not shown) which are inserted through bores 152C, 154C and threaded into nodes 170 (see FIG. 3). Grooves 152D, 154D serve to prevent rotation of each node. Each node may be removed from underneath without requiring disassembly of the bottom pallet. Deck plates 142, 144 are placed over base member 110 and subframe 150 as shown. In particular, lips 142B, 144B overlie the upper, lengthwise edges of cross bars 142, 144 and the entireties of connector bars 158. Deck plates 142, 144 are held in place by fasteners (preferably self-tapping screws) 148 which extend through bores 142D, 144D and are secured in bores 112E, 114E, 116E, and 118E.

As best seen in FIG. 2, the open ends of cross bars 152, 154 are covered by walls 112C, 116C. The height of skirts 142A, 144A of the deck plates, the widths of the deck plates, the depths of the recesses and channels, and the heights of the cross bars are chosen such that lips 142B, 144B overlap and fit tightly against the upper surfaces of the cross bars. In this way, a continuous support surface is formed by the deck plates and the upwardly exposed portions of the cross bars.

The various components of the base pallet 100 may be selectively removed and replaced as desired. The self-tapping screws which secure the nodes 170 to subframe 150 may be accessed through the base member so that each node may be removed and re-installed without disassembly of the base pallet. Each deck plate may be removed and re-installed by removing the associated fasteners 148. The subframe or the base member may be removed by removing the deck plates and fasteners 157.

The bottom pallet 100 as described above provides numerous benefits. By locating the load points over the forklift passages, a 2-2-2 array of yarn packages may be placed on the pallet (as shown in FIG. 9) while still providing a forklift opening configuration in compliance with accepted industry standards. The aluminum subframe increases the overall strength of the pallet while the deck plates and base members protect the subframe from damage. The relatively high rigidity of the aluminum subframe allows for a reduction in the height of the base pallet, and thereby the overall height of the pallet system. The aluminum subframe serves to more effectively distribute the loads. As a result, even if one or more of the feet are damaged so that they no longer provide support, the loaded pallet system will remain stable. Further, the aluminum subframe substantially reduces flexing of the loaded pallet when it is lifted by a forklift (i.e., when the feet are unweighted). For this reason, and as a result of the general resistance to flex underload, the rigid aluminum subframe allows a tensioned film to perform optimally in stabilizing the pallet system. The use of an extruded aluminum subframe is also advantageous because metal extrusion technology is more prevalent (especially in less industrialized countries) than plastics molding technology.

The plastic base member is desirable for handling and conveying. The modular construction of the bottom pallet allows for the repair of sub-parts without requiring disposal of the entire pallet. In particular, parts having different service lives can be replaced at different times so that every part may be used for its entire service life. The continuous support surface provided by the combination of the deck plates and the cross bars prevents dust and moisture from entering the package area from underneath the pallet. As a result, the pallet system need only be film wrapped about its sides and top to provide a fully sealed environment.

Figure 5:
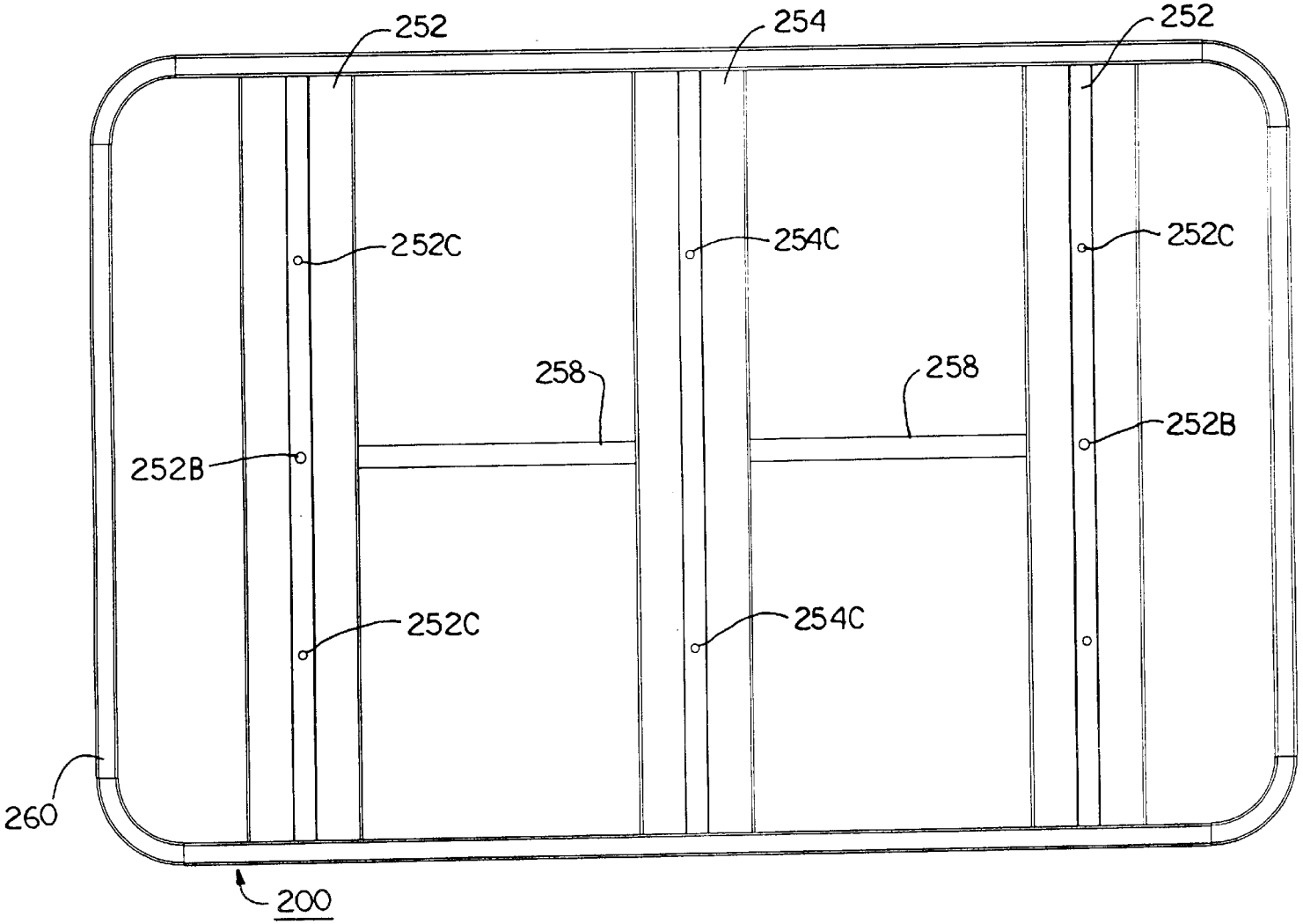
FIG. 5 is a top plan view of a cover pallet according to the present invention.

With reference to FIGS. 5, 7, and 8, cover pallet 200 is shown therein. Top pallet 200 is preferably formed of extruded aluminum. However, other suitable materials, for example, steel tubing or a glass-reinforced polycarbonate molding, may be used as well. Cover pallet 200 has outside cross bars 252 and intermediate cross bar 254 of the same construction and dimensions as cross bars 152 and 154, respectively, of the bottom pallet except that the outwardly facing surfaces of cross bars 252, 254 are not angled as are walls 152A, 154A. Connector bars 258 connect each of outside cross bars 252 to intermediate cross bar 254. Peripheral frame tube 260 extends continuously about cover pallet 200 and is welded or otherwise secured to the ends of cross bars 252, 254. Locator nodes 170 are secured to the underside of top pallet 200 by self-tapping screws (not shown) which extend through bores 252D, 254C. Resilient bumpers 270 are secured to the upper side of cover pallet 200 by self-tapping screws which extend through apertures 252B. Connector bars 258 also serve as handles for lifting and positioning cover pallet 200 and are preferably cylindrical.

Figure 6:
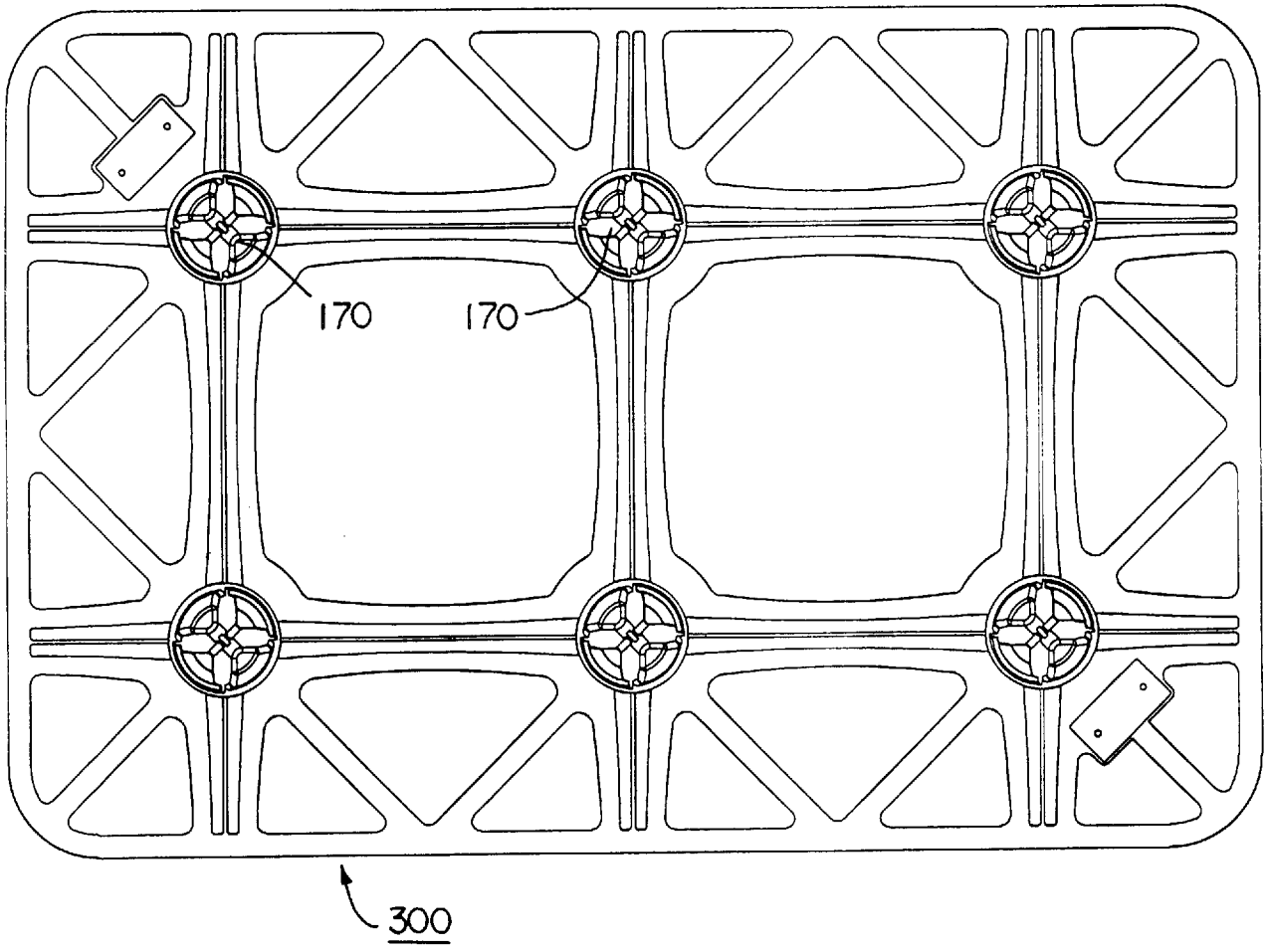
FIG. 6 is a top plan view of a separator pad forming a part of the pallet system according to the present invention.

Separator pads 300, as best seen in FIG. 6, have locator nodes 170 extending from the upper and lower surfaces thereof in the same placement as the locator nodes of the base pallet and the cover pallet. Separator pads 300 are preferably formed of high density polyethylene. It will be appreciated that separator pads of other suitable configurations and constructions may be used as well.

The bottom pallet as described above may be used with components other than those described herein. Likewise, cover pallet 200 may be used in other pallet systems. However, the combination of the bottom pallet 100 as described and the cover pallet 200 as described is especially effective for the transport and handling of yarn packages. Also, each of the bottom and top pallets as described may be used in a pallet system not using tensioned film, but the pallet system is particularly advantageous when used with films.

While a preferred embodiment of the present invention has been described, it will be appreciated by those of skill in the art that certain modifications may be made without departing from the scope of the present invention. All such modifications are intended to come within the scope of the claims which follow.

What is claimed is:

1. A pallet comprising:

a) a base member having first and second ends, said base member including:

i) at least two spaced apart first feet formed on said first end and defining a first gap therebetween;

ii) at least two spaced apart second feet formed on said second end and defining a second gap therebetween; and iii) at least two spaced apart intermediate feet formed between said first and second ends of said base member and defining an intermediate gap therebetween;

b) a subframe removably mounted on said base member, said subframe including a first cross bar, a second cross bar spaced apart from said first cross bar, and at least one intermediate cross bar disposed between and spaced apart from each of said first and second cross bars, said first, second, and intermediate cross bars overlying and supported by said first, second, and intermediate feet, respectively, and spanning said first, second and intermediate gaps, respectively; and c) at least one locator node secured to an upper surface of one of said cross bars at a location overlying one of said first, second, and intermediate gaps defined in said base member.

2. The pallet of claim 1 including at least one connector bar joining said first, second, and intermediate cross bars to one another.

3. The pallet of claim 1 wherein each said foot includes a recess defined therein and portions of said cross bars are disposed in said recesses.

4. The pallet of claim 1 wherein said base member is molded from polymeric material.

5. The pallet of claim 1 wherein said first, second, and intermediate cross bars are formed of a material having a flexural modulus of at least 35,000 MPa.

6. The pallet of claim 5 wherein said material is aluminum.

7. The pallet of claim 1 wherein each of said cross bars has opposed, free ends overlying said feet of said base member.

8. The pallet of claim 1 including at least one deck plate overlying and detachably secured to said base member.

9. The pallet of claim 8 wherein said deck plate is detachably secured to said base member by at least one fastener.

10. The pallet of claim 8 wherein said at least one deck plate is formed of polymeric material.

11. The pallet of claim 8 wherein said subframe is interposed between said base member and said deck plate.

12. The pallet of claim 8 including a plurality of said deck plates.

13. The pallet of claim 12 wherein said subframe and said deck plates together form a substantially continuous support surface.

14. A pallet comprising:

a) a base member having a plurality of feet defining a plurality of gaps between adjacent said feet;

b) a subframe including a plurality of cross bars, each of said cross bars overlying and supported by said feet and spanning said gaps defined c) at least one locator node secured to an upper surface of one of said cross bars at a location overlying one of said gaps defined in said base member d) a deck plate overlying said base member; and e) fastening means operative when engaged to selectively secure said subframe and said deck plate to said base member, and wherein each of said base member, said subframe, and said deck plate may be selectively separated from one another by disengaging said fastening means.

15. The pallet of claim 14 wherein said subframe is interposed between said deck plate and said base member.

16. The pallet of claim 14 including at least one connector bar joining said cross bars to one another.

17. The pallet of claim 14 wherein each said foot includes a recess defined therein and portions of said cross bars are disposed in said recesses.

18. The pallet of claim 14 wherein said cross bars are formed of a material having a flexural modulus of at least 35,000 MPa.

19. The pallet of claim 18 wherein said material is aluminum.

20. The pallet of claim 18 wherein each of said base member and said deck plate are formed of polymeric material and said subframe is formed of metal.

21. The pallet of claim 14 wherein each of said cross bars has opposed, free ends overlying said feet of said base member.

22. The pallet of claim 14 including a plurality of said deck plates.

23. The pallet of claim 22 wherein said subframe and said deck plates together form a substantially continuous support surface.

24. A pallet for supporting a plurality of packages, said pallet comprising:

a) a base member having a plurality of feet defining a plurality of gaps between adjacent said feet;

b) a subframe including a plurality of cross bars, each of said cross bars overlying and supported by said feet and spanning said gaps defined between said feet; and c) a package position for each of the packages, each said package position located along a respective one of said cross bars and directly overlying a respective one of said gaps such that each of the packages when mounted on the pallet at a respective one of said package positions is suspended above said respective gap by said respective cross bar.

25. The pallet of claim 24 wherein each of said cross bars has opposed, free ends overlying said feet of said base member.

26. The pallet of claim 24 including a locator node secured to upper surfaces of said cross bars at each of said package positions.

27. The pallet of claim 24 including at least one connector bar joining said cross bars to one another.

28. The pallet of claim 27 wherein each said foot includes a recess defined therein and portions of said cross bars are disposed in said recesses.

29. The pallet of claim 27 wherein said cross bars are formed of a material having a flexural modulus of at least 35,000 MPa.

30. The pallet of claim 29 wherein said material is aluminum.

31. The pallet of claim 29 wherein each of said base member and said deck plate are formed of polymeric material and said subframe is formed of metal.

* * * * *

UNITED STATES PATENT AND TRADEMARK OFFICE

CERTIFICATE OF CORRECTION

PATENT NO : 5,809,904
DATED : September 22, 1998
INVENTOR(S) : Robert J. Darby

It is certified that error appears in the above-identified patent and that said Letters Patent is hereby corrected as shown below:

In Claim 14 b), line 29, insert the words -- between said feet; -- after the word defined.

Signed and Sealed this

Fifteenth Day of December, 1998

Bruce Lehman

*Attest:*

BRUCE LEHMAN

*Attesting Officer*

*Commissioner of Patents and Trademarks*